US007806227B2

(12) United States Patent
Wang

(10) Patent No.: US 7,806,227 B2
(45) Date of Patent: Oct. 5, 2010

(54) HIGH-PERFORMANCE FULL-RANGE SPEAKER ASSEMBLY

(76) Inventor: Li-Pen Wang, 3F, 10, Alley 4, Lane 106, Sec. 4, Bade Road, Taipei (TW)

( * ) Notice: Subject to any disclaimer, the term of this patent is extended or adjusted under 35 U.S.C. 154(b) by 0 days.

(21) Appl. No.: 12/476,359

(22) Filed: Jun. 2, 2009

(65) Prior Publication Data

US 2010/0140012 A1 Jun. 10, 2010

(30) Foreign Application Priority Data

Dec. 4, 2008 (TW) ..... 97221682 U

(51) Int. Cl.
*H04R 1/28* (2006.01)

(52) U.S. Cl. ..... 181/153; 181/199; 381/334; 381/336

(58) Field of Classification Search ..... 181/148, 181/152, 153, 199; 381/334, 336, 337, 338, 381/345, 386

See application file for complete search history.

(56) References Cited

U.S. PATENT DOCUMENTS 6,628,799 B2 * 9/2003 Fukuda ..... 381/398
7,350,618 B2 * 4/2008 Goh et al. ..... 181/156
7,441,630 B1 * 10/2008 Herrington et al. ..... 181/199
2002/0076062 A1 * 6/2002 Juszkiewicz et al. ..... 381/89
2002/0114485 A1 * 8/2002 Ohira et al. ..... 381/386
2004/0105565 A1 * 6/2004 Butters et al. ..... 381/347
2006/0153413 A1 * 7/2006 Nakajima et al. ..... 381/345
2007/0154044 A1 * 7/2007 Oxford et al. ..... 381/336
2008/0056516 A1 * 3/2008 Christian ..... 381/303
2009/0038878 A1 * 2/2009 Imamura et al. ..... 181/148

* cited by examiner

*Primary Examiner*—Jeffrey Donels
*Assistant Examiner*—Jeremy Luks
(74) *Attorney, Agent, or Firm*—Ming Chow; Sinorica, LLC

(57) ABSTRACT

A high-performance, full-range speaker includes a front horn having a channel tube located on the inside at the bottom side, a rear cover shell, a holder base defining a sound transmission passage, a speaker unit mounted on the holder base, a control circuit board, an equalizer mounted in the sound transmission passage of the holder base to buffer the gain of the treble of the forward waves produced by the speaker unit and to balance the mid-range, a bass resonator, a rack and first, second, third and fourth resonance chambers in air communication with the channel tube and the bass resonator to eliminate noises and to amplify the bass.

9 Claims, 10 Drawing Sheets

HIGH-PERFORMANCE FULL-RANGE SPEAKER ASSEMBLY

BACKGROUND OF THE INVENTION

1. Field of the Invention

The present invention relates to speakers and more particularly, to a high-performance, full-range speaker assembly formed of a front horn and a rear bass tube.

2. Description of the Related Art

Digitalized MP3/MP4 music/image files can be stored in different storage cards and memory devices for carrying conveniently. Therefore, MP3/MP4 music/image data storage devices have become the mainstream in music/image data storage media. In consequence, mobile MP3/MP4 players and mobile phones with MP3/MP4 playing function have become more and more popular. However, a mobile phone user can simply use earphones to hear the voice when operating the mobile phone to play MP3/MP4 music or image files. When wishing to let the sound be distributed into the open air, a speaker shall be used.

For full-range output, a tweeter, a squawker and a woofer must be installed in a fox and connected to an audio splitter in a box. When received a sound source signal, the audio splitter splits the sound source signal into high frequency, middle frequency and low frequency, and then transmits high frequency, middle frequency and low frequency to the tweeter, the squawker and the woofer for output. However, a speaker for use with a mobile MP3/MP4 player means must have the characteristics of small size and high mobility. Therefore, conventional full-range speakers are not suitable for this application.

Many different mini speakers have been created, and have appeared on the market. Speaker manufacturers are trying hard to improve the output sound effect of mini speakers. They may make holding spaces at the periphery of the housing at different locations for the positioning of multiple speaker units to enhance sound field effect. However, this method cannot achieve the expected result. Adding multiple speaker units to the housing relatively increases the dimension of the speaker, reducing the advantage of mobility.

SUMMARY OF THE INVENTION

The present invention has been accomplished under the circumstances in view. It is one object of the present invention to provide a high-performance, full-range speaker assembly, which has small characteristic and is formed of a front horn that amplifies treble and mid-range waves in a specific direction and a rear bass tube that amplify bass waves.

To achieve this and other objects of the present invention, a high-performance, full-range speaker assembly comprises a front horn, a rear cover shell, a holder base, a speaker unit, at least one control circuit board, an equalizer, a bass resonator, a rack, a volume control, a rear cover shell, and first, second, third and fourth resonance chambers. The front horn has a channel tube arranged on the inside around the border, a reflection space in air communication with the channel tube, and a grille. The holder base defines a sound transmission passage in air communication with the channel tube. The speaker unit is mounted on the holder base with the sound output side thereof facing the sound transmission passage. The holder base is set between the bass resonator and the rack. The holder base has a rectangular open side that defines the first resonance chamber. The control circuit board is mounted in the rear cover shell and adapted to receive an external sound source signal and to transmit the signal to the speaker unit.

The equalizer is mounted in the sound transmission passage of the holder base to buffer the gain of the treble of the forward waves produced by the speaker unit and to balance the mid-range. The bass resonator is set between the front horn and the holder base. The base resonator comprises a trapezoidal first resonator tube, a trapezoidal second resonator tube and a cover. The trapezoidal first resonator tube and the trapezoidal second resonator tube are perpendicularly connected to the cover and respectively disposed at the right side and the left side. The channel tube of the front horn has one side opened. The bass resonator is joined to the open side of the channel tube constituting a bass tube main structure to eliminate noises.

When compared to conventional techniques, the forward waves produced by the speaker unit are emitted by the front horn, wherein the high frequency sound waves are buffered by the equalizer and transmitted to the front horn for output to produce pleasant treble. The first resonance chamber, the second resonance chamber, the third resonance chamber and the fourth resonance chamber resound the low frequency backward sound waves to match with the performance of the resonance zones of the trapezoidal first bass resonator tube and trapezoidal second bass resonator tube and the channel tube that amplify bass waves, achieving high-performance, full-range speaker functions.

DETAILED DESCRIPTION OF THE PREFERRED EMBODIMENT

Figure 1:
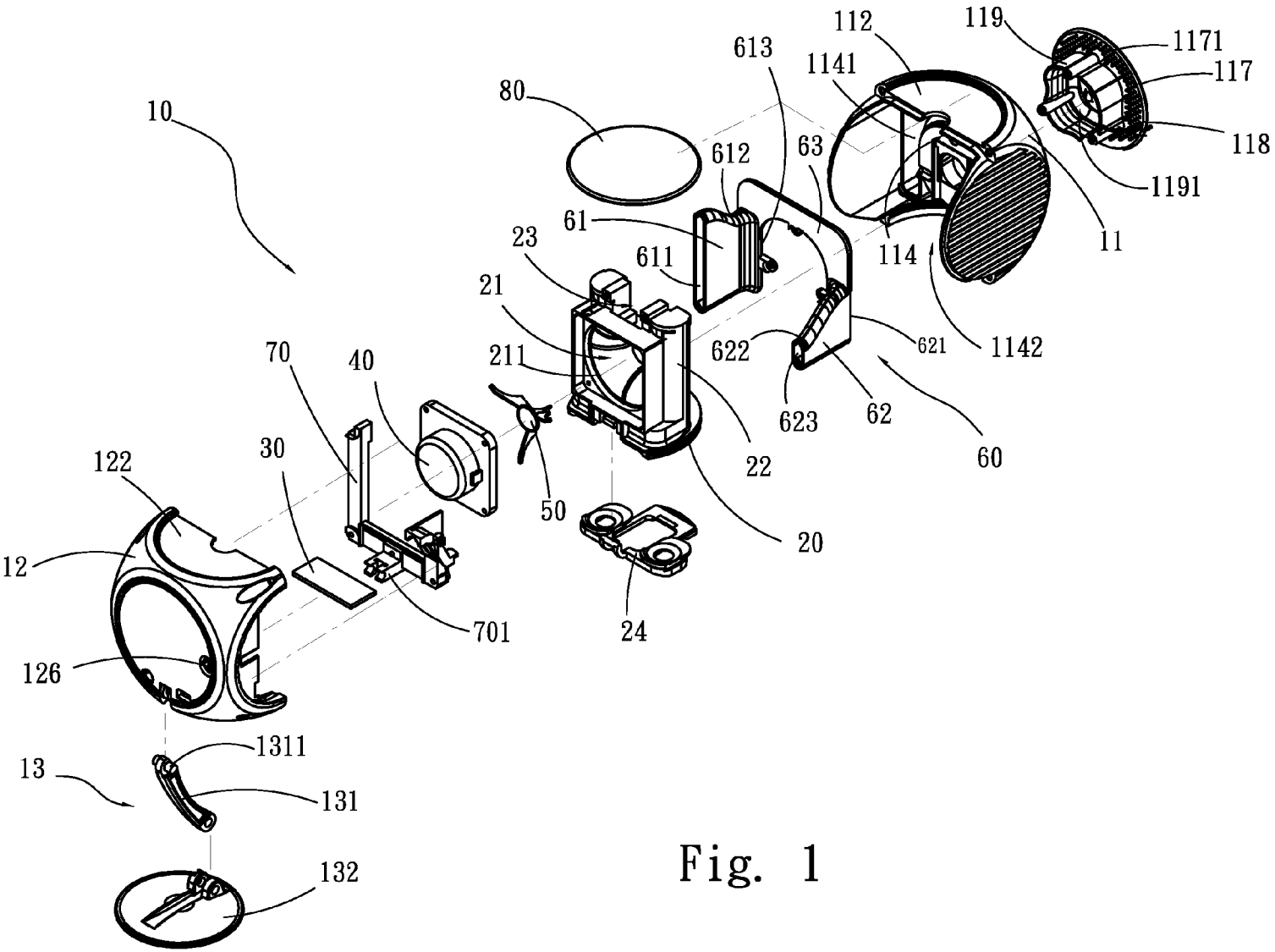
FIG. 1 is an exploded of a high-performance, full-range speaker assembly in accordance with the present invention.

Referring to FIGS. 1~7, a high-performance, full-range speaker assembly 10 is shown comprising a front horn 11, a rear cover shell 12, a holder base 20, at least one control circuit board 30, a speaker unit 40, an equalizer 50, a bass resonator 60, a rack 70, a volume control 80, a first resonance chamber 23, a second resonance chamber 123, a third resonance chamber 124 and a fourth resonance chamber 125.

Referring to FIGS. 1~4, the front horn 11 is a reflective horn, comprising a first accommodation chamber 112, a reflection space 113, a channel tube 114, a tubular post 115, a first reflection hole 116 and a grille 117. The grille 117 is a T-shaped member having a grille panel 118, a box tube 119 perpendicularly extended from the back side of the grille panel 118, a plurality of sound holes 1171 cut through the grille panel 118 around the box tube 119, and a second reflection hole 1191 defined in the box tube 119. The sound holes 1171 are disposed in communication the reflection space 113 of the front horn 11. The box tube 119 is sleeved onto the tubular post 115 to keep the second reflection hole 1191 in communication with the first reflection hole 116 for reflecting forward sound waves. The first accommodation chamber 112 is a recessed chamber located on the top side of the front horn 11. The reflection space 113 is located on the front side of the front horn 11. The channel tube 114 is disposed inside the front horn 11. According to this embodiment, the channel tube 114 is a rectangular channel tube extending around the bottom side of the first accommodation chamber 112 and having the open side thereof facing upwards. The tubular post 115 is located on the center of the conical inner side of the reflection space 113. The first reflection hole 116 is defined in the tubular post 115. Sound waves radiated from the first reflection hole 116 are reflected by the second reflection hole 1191 into the reflection space 113.

Referring to FIGS. 1~7, the holder base 20 defines therein a sound transmission passage 21 in air-communication with the reflection space 113, two battery cambers 22 and the aforesaid first resonance chamber 23, having a battery lid 24 attached thereto. The holder base 20 is set between the bass resonator 60 and the rack 70, and secured in place by the front horn 11 and the rear cover shell 12. The sound transmission passage 21 forms a big throat 211 (see FIG. 6) that faces the speaker unit 40, and a small throat 212 (see FIG. 7) that faces the rear cover shell 12, i.e., the sound transmission passage 21 has a diameter gradually reducing in direction from the rear cover shell 12 toward the front horn 11 so that forward sound waves produced by the speaker unit 40 are gathered and transmitted through the big throat 211 and the small throat 212 to the front horn 11 for output. The two battery chambers 22 are disposed at two sides relative to the sound transmission passage 21 at a relatively higher elevation so that a rectangular opening is defined between the two battery chambers 22 to form the aforesaid first resonance chamber 23. The battery lid 24 is covered on the battery chambers 22 to hold battery cells (not shown) inside the battery chambers 22 that provide the necessary power to drive the speaker unit 40.

Figure 8:
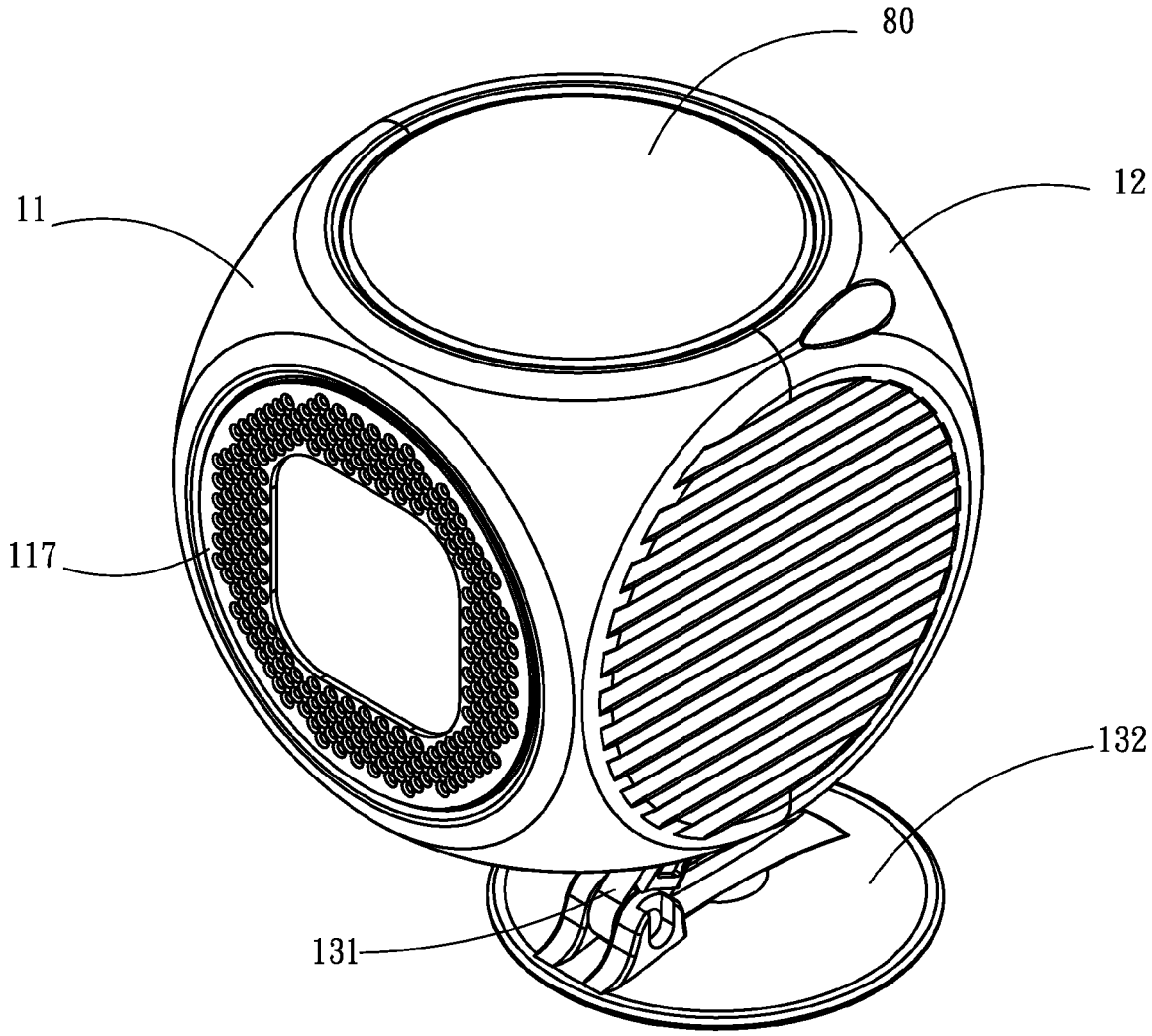
FIG. 8 is an elevational view of the high-performance, full-range speaker assembly in accordance with the present invention.

The rear cover shell 12 has a recessed chamber located on the top side thereof, forming a second accommodation chamber 122. The rear cover shell 12 further has a locating groove 121 and an air vent 126. The control circuit board 30 is fixedly mounted in the locating groove 121 of the rear cover shell 12 to receive signal from an external sound source. The rack 70 is fastened to the rear cover shell 12 (see FIGS. 3, 4 and 8) and abutted against the control circuit board 30, thereby defining therebetween the said second resonance chamber 123. The second resonance chamber 123 is disposed at the right side inside the rear cover shell 12. The aforesaid third resonance chamber 124 is defined at the left side inside the rear cover shell 12. The front horn 11 accommodates the holder base 20, the speaker unit 40, the equalizer 50 and the bass resonator 60, and is then fastened to the rear cover shell 12, completing the internal and external structures of the present invention (see FIG. 3 and FIG. 8). The first accommodation chamber 112 and the connected second accommodation chamber 122 constitute a chamber for accommodating the volume control 80. Further a fourth resonance chamber 125 is defined in the rear cover shell 12 in air communication with the first resonance chamber 23, the second resonance chamber 123 and the third resonance chamber 124. The air vent 126 is disposed in air communication with the fourth resonance chamber 125, and adapted to release the pressure of the spring constant of the sound waves in the fourth resonance chamber 125 for damping the audio frequency of the posterior bass tube.

The volume control 80 is mounted in the chamber formed of the first accommodation chamber 112 and the second accommodation chamber 122. The control circuit board 30 and the volume control 80 are electrically connected to the battery cells in the battery chambers 22. The volume control 80 is rotatable to regulate the sound source signal output of the control circuit board 30. The battery cells provide the control circuit board 30 with the necessary working voltage.

Figure 2:
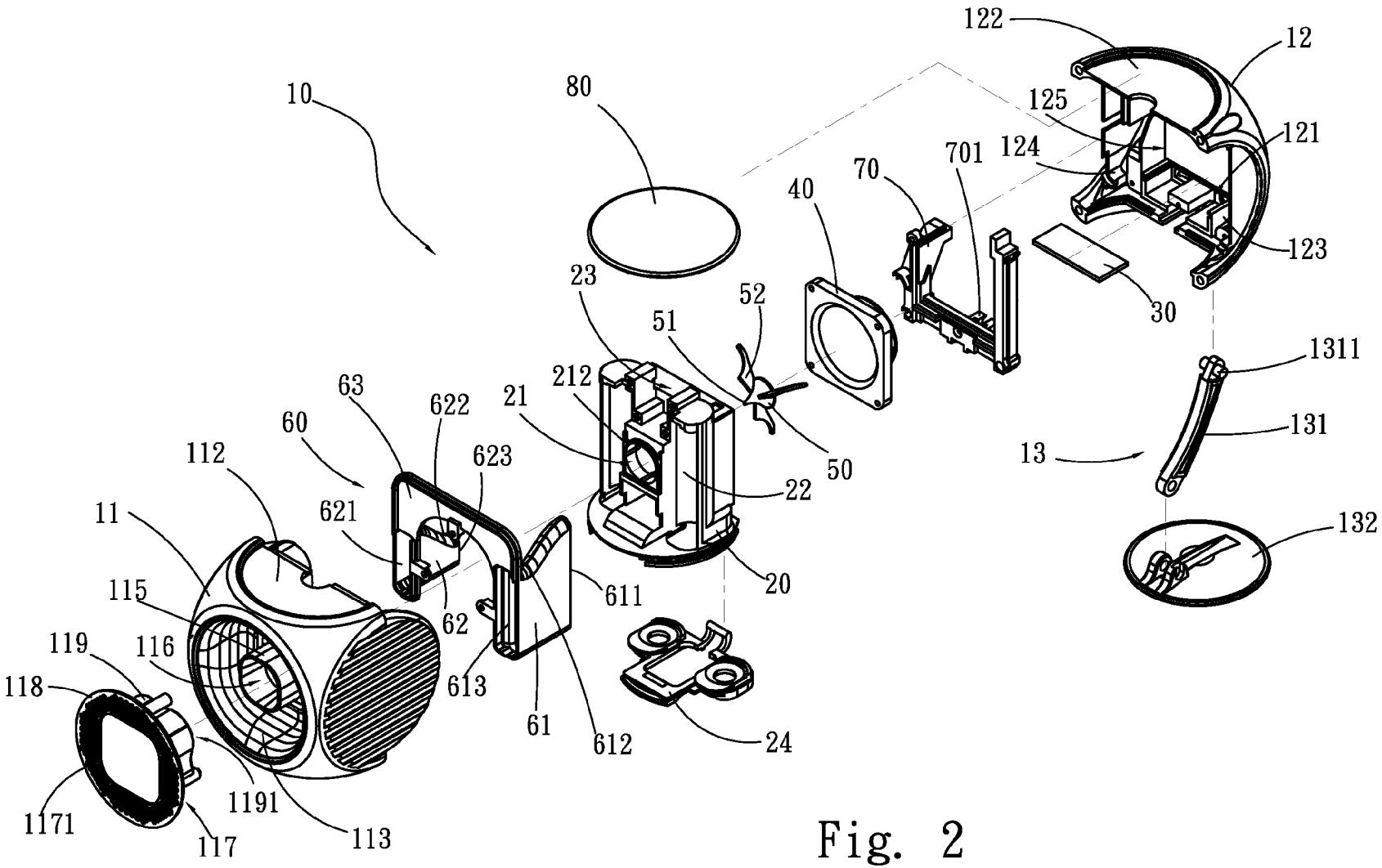
FIG. 2 corresponds to FIG. 1 when viewed from another angle.
Figure 3:
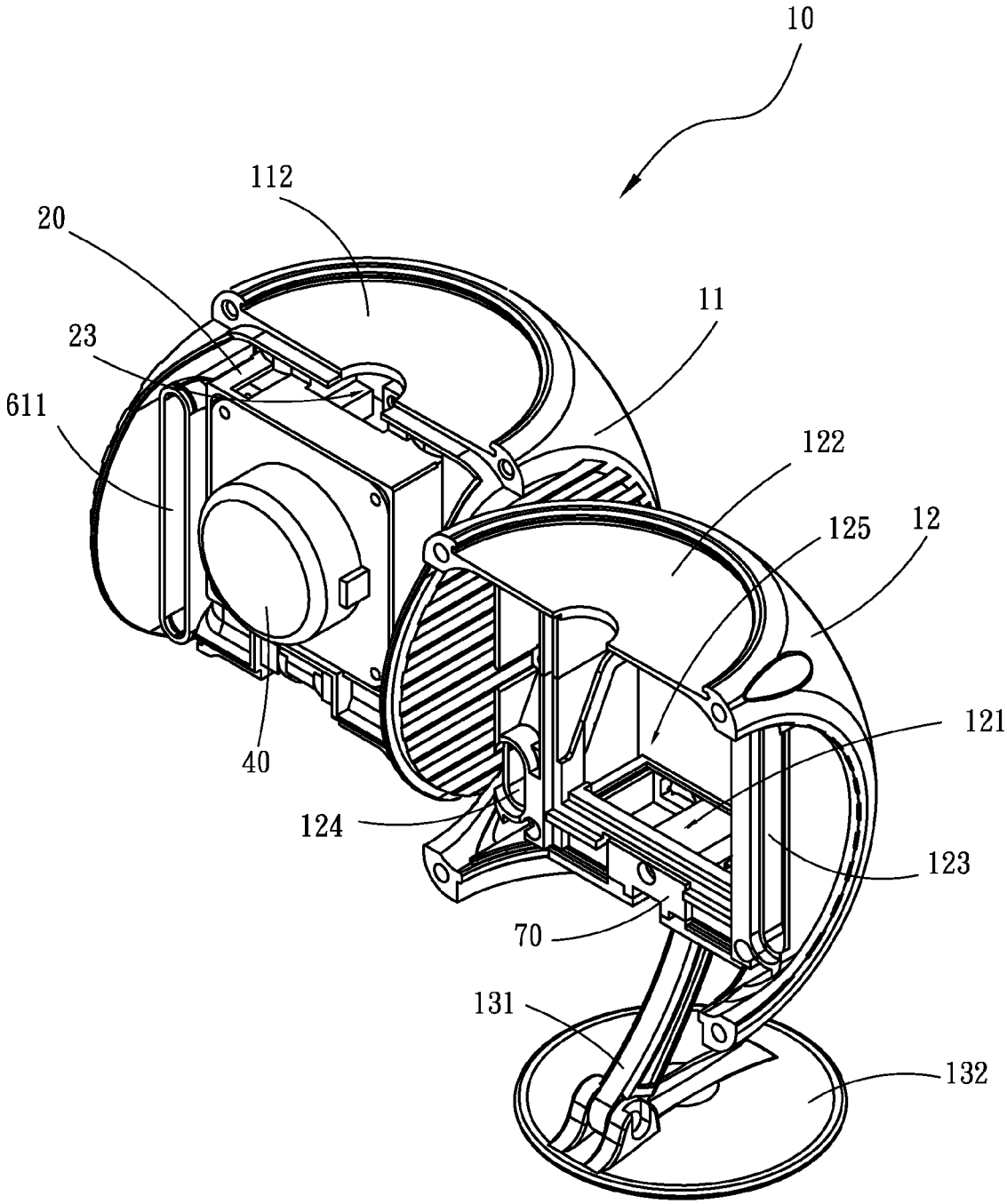
FIG. 3 is an extended view of the high-performance, full-range speaker assembly in accordance with the present invention.
Figure 4:
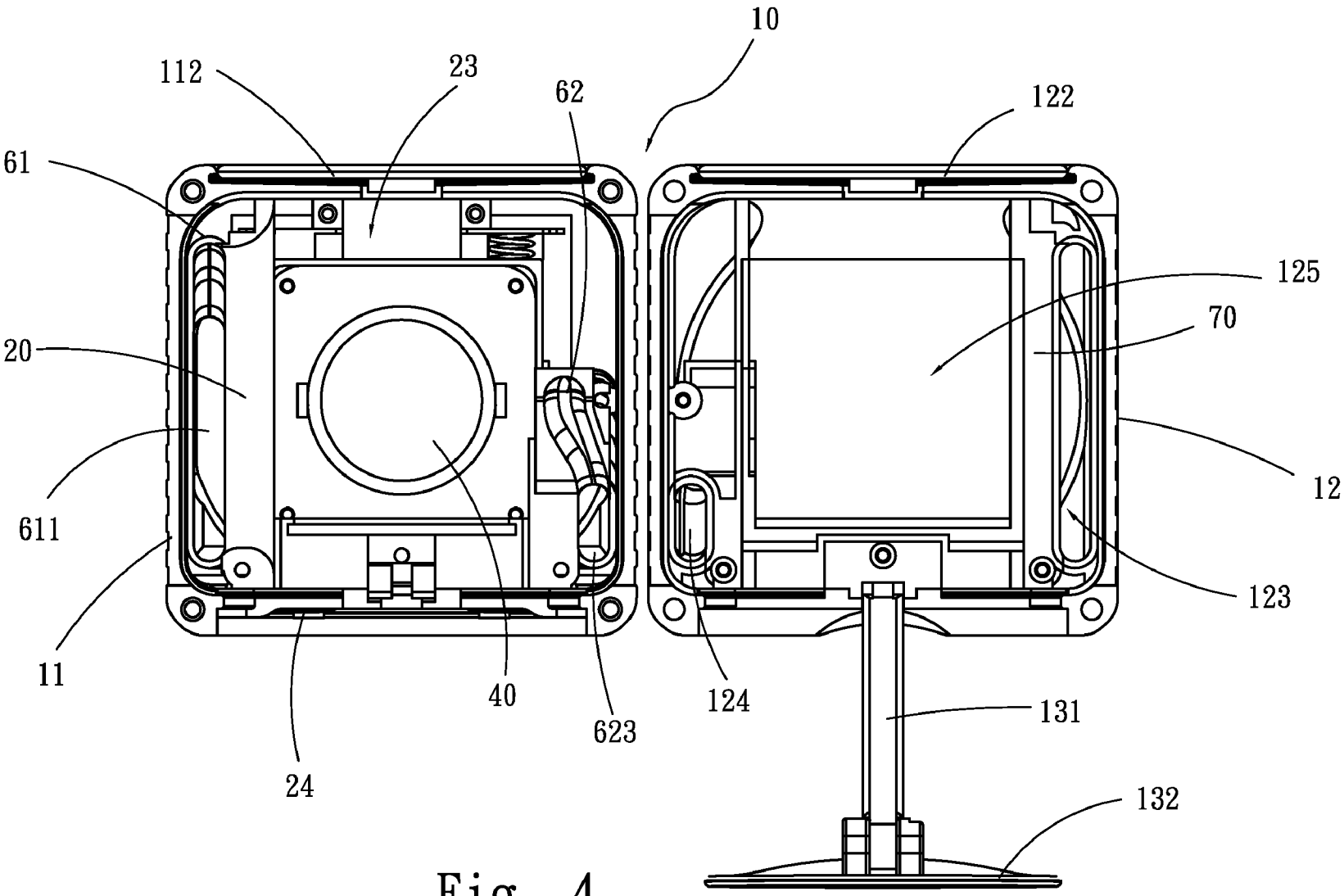
FIG. 4 is a front plain view in an enlarged scale of FIG. 3.
Figure 5:
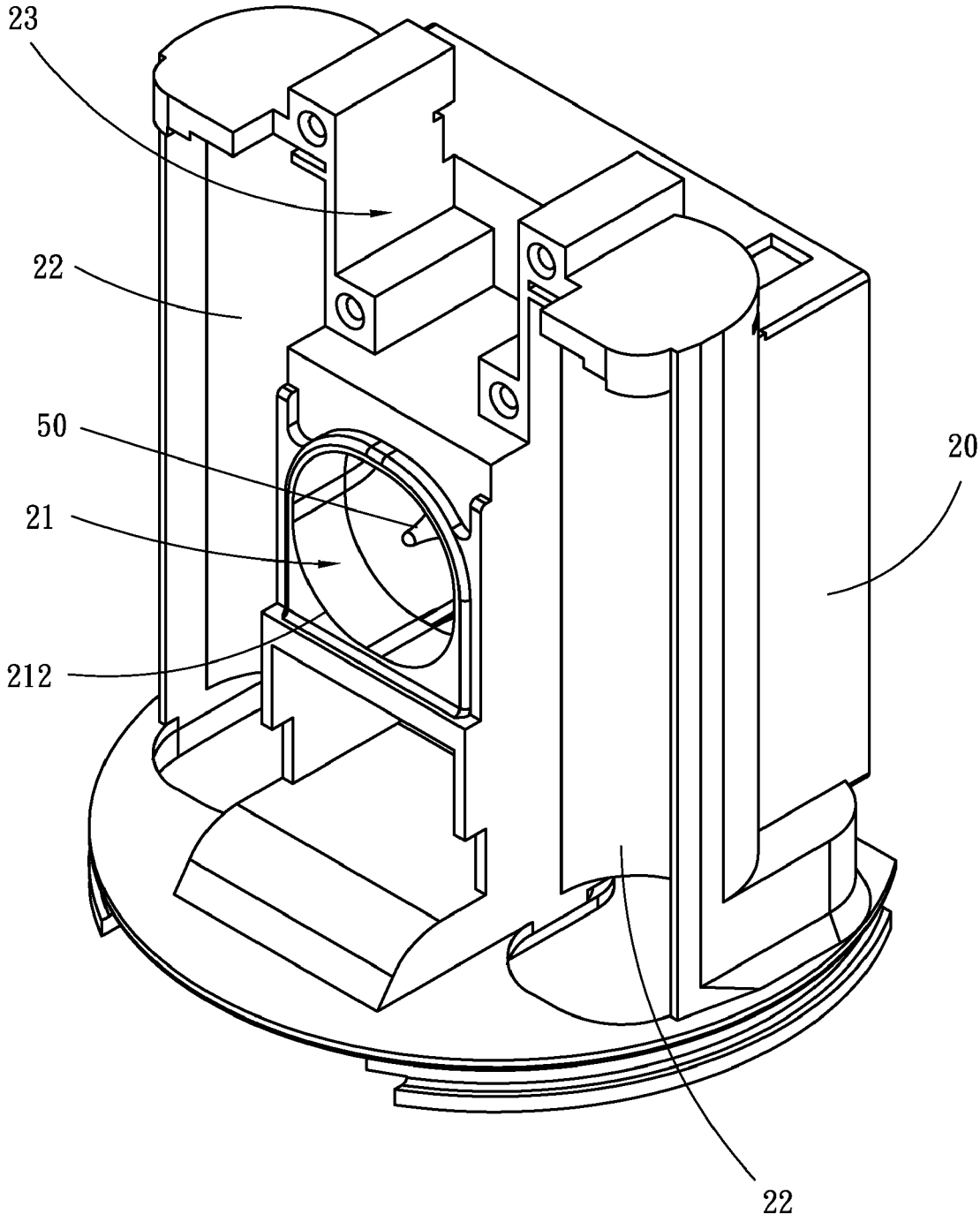
FIG. 5 is an elevational view in an enlarged scale of a part of FIG. 1, showing the structure of the holder base.
Figure 6:
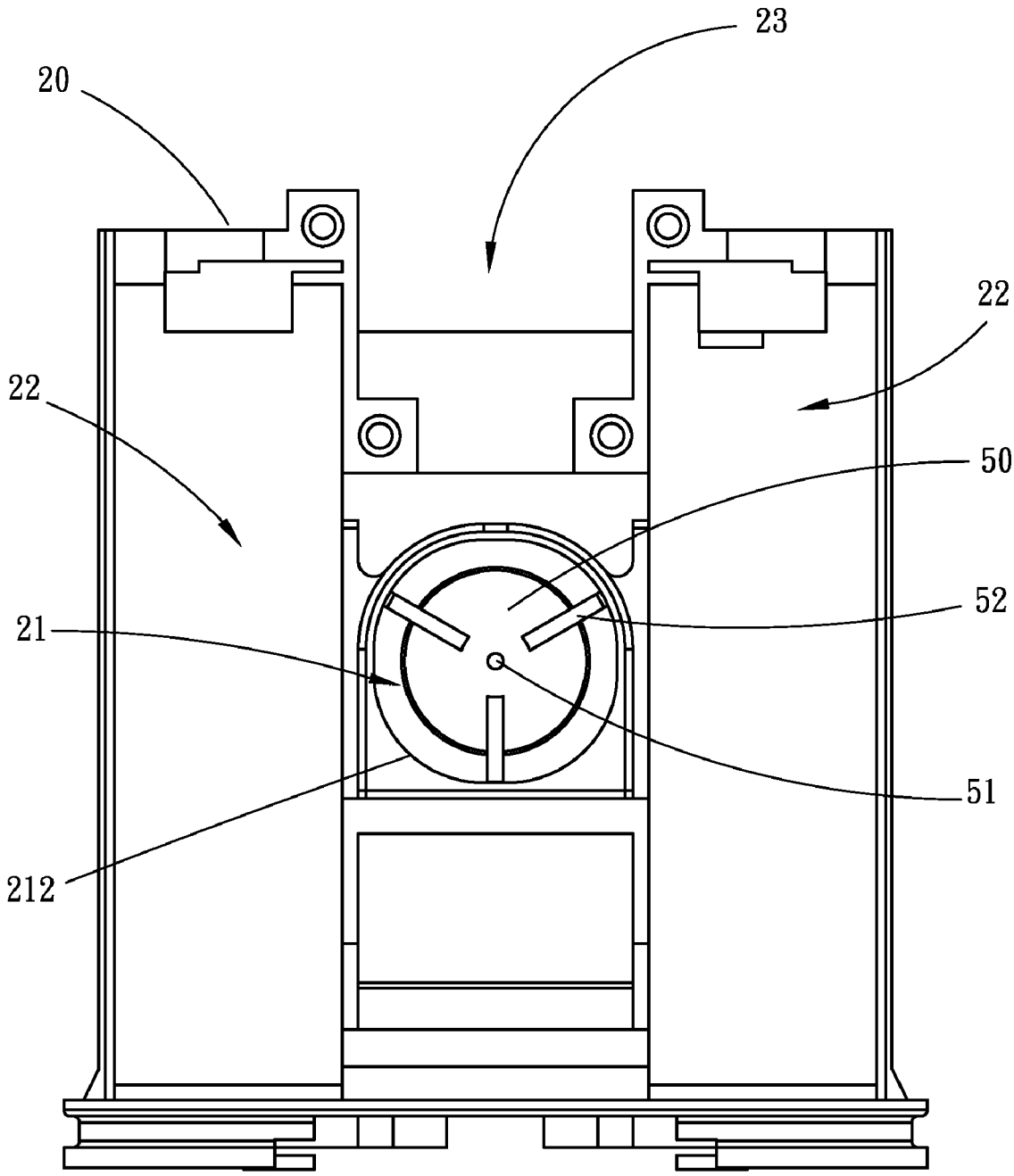
FIG. 6 is a front plain view of FIG. 5.
Figure 7:
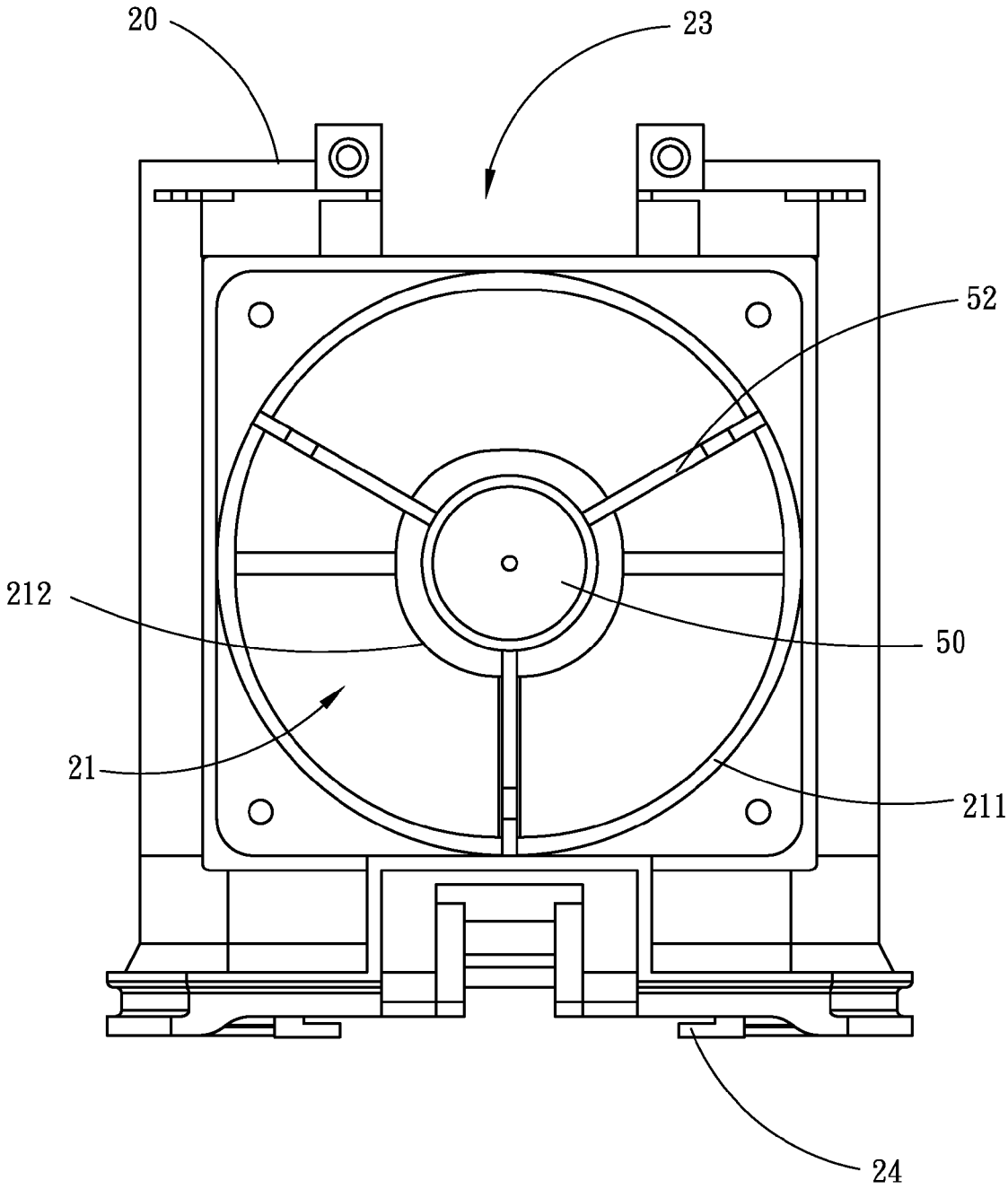
FIG. 7 is an enlarged view of a part of FIG. 6.

Referring to FIGS. 1 and 2, the equalizer 50 has a cone head 51 and a plurality of supporting members 52 respectively and equiangularly extended from the rear side of the cone head 51. The cone head 51 is inserted into the sound transmission passage 21 of the holder base 20. The supporting members 52 are secured to the holder base 20 to hold the cone head 51 in the sound transmission passage 21.

Referring to FIGS. 1~4, the speaker unit 40 is affixed to the holder base 20 to block the rear side of the equalizer 50. The voice output side of the speaker unit 40 faces the sound transmission passage 21. The speaker unit 40 is electrically connected to the control circuit board 30. When the control circuit board 30 transmits a sound signal to the speaker unit 40, the speaker unit 40 is driven to output forward sound waves, and the equalizer 50 alters the frequency response characteristics to buffer the gain of treble and to equalize the middle. The sound waves are transmitted through the big throat 211 of the sound transmission passage 21 to the small throat 212 and then the front horn 11 for output.

Referring to FIGS. 1~4, the bass resonator 60 is mounted in the channel tube 114 inside the front horn 11, comprising a trapezoidal first bass resonator tube 61, a trapezoidal second bass resonator tube 62 and a cover 63. The trapezoidal first bass resonator tube 61 and the trapezoidal second bass resonator tube 62 have a predetermined length. The trapezoidal first bass resonator tube 61 has a sound inlet 611, a sound outlet 613, and a resonance zone 612 in air communication between the sound inlet 611 and the sound outlet 613. The diameter of the sound outlet 613 is relatively smaller than the sound inlet 611. The trapezoidal second bass resistor tube 62 has a sound inlet 621, a sound outlet 623, and a resonance zone 622 in air communication between the sound inlet 621 and the sound outlet 623. The diameter of the sound outlet 623 is relatively smaller than the sound inlet 621. The diameter of the trapezoidal first bass resonator tube 61 and the diameter of the trapezoidal second bass resonator tube 62 respectively gradually reduce in direction from the respective sound inlets 621 toward the respective sound outlets 623 to smoothly guide low frequency sound waves to the resonance zones 612 and 622 for resonance to eliminate tube to obtain sound waves of specific tones.

According to the present preferred embodiment, the first bass resonator tube 61 and the second bass resonator tube 62 have a flat structure to reduce space occupation so that the speaker assembly has a small size characteristic. The first bass resonator tube 61 and the second bass resonator tube 62 are respectively perpendicularly connected to the cover 63 at two opposite lateral sides. The cover 63 is adapted to cover the middle part of the middle open side of the channel tube 114. The sound outlet 613 of the trapezoidal first bass resonator tube 61 surrounds the right open side 1141 of the channel tube 114, the sound inlet 621 of the trapezoidal second bass resonator tube 62 surrounds the left open side 1142 of the channel tube 114, the sound inlet 611 of the trapezoidal first bass resonator tube 61 is connected to the second resonance chamber 123, and the sound outlet 623 of the trapezoidal second resonator tube 62 is connected to the third resonance chamber 124, and thus an enclosed bass tube main structure is constituted to eliminate noises, thereby improving bass quality.

During operation, the low-frequency backward harmonic waves produced by the speaker unit 40 are gathered in the first resonance chamber 23 and the fourth resonance chamber 125 and then guided through the second resonance chamber 123, the trapezoidal first bass resonator tube 61, the channel tube 114, the trapezoidal second bass resonator tube 62 and the third resonance chamber 124 and then returned to the fourth resonance chamber 125 and the second resonance chamber 12 to eliminate noises and to amplify the bass.

Figure 9:
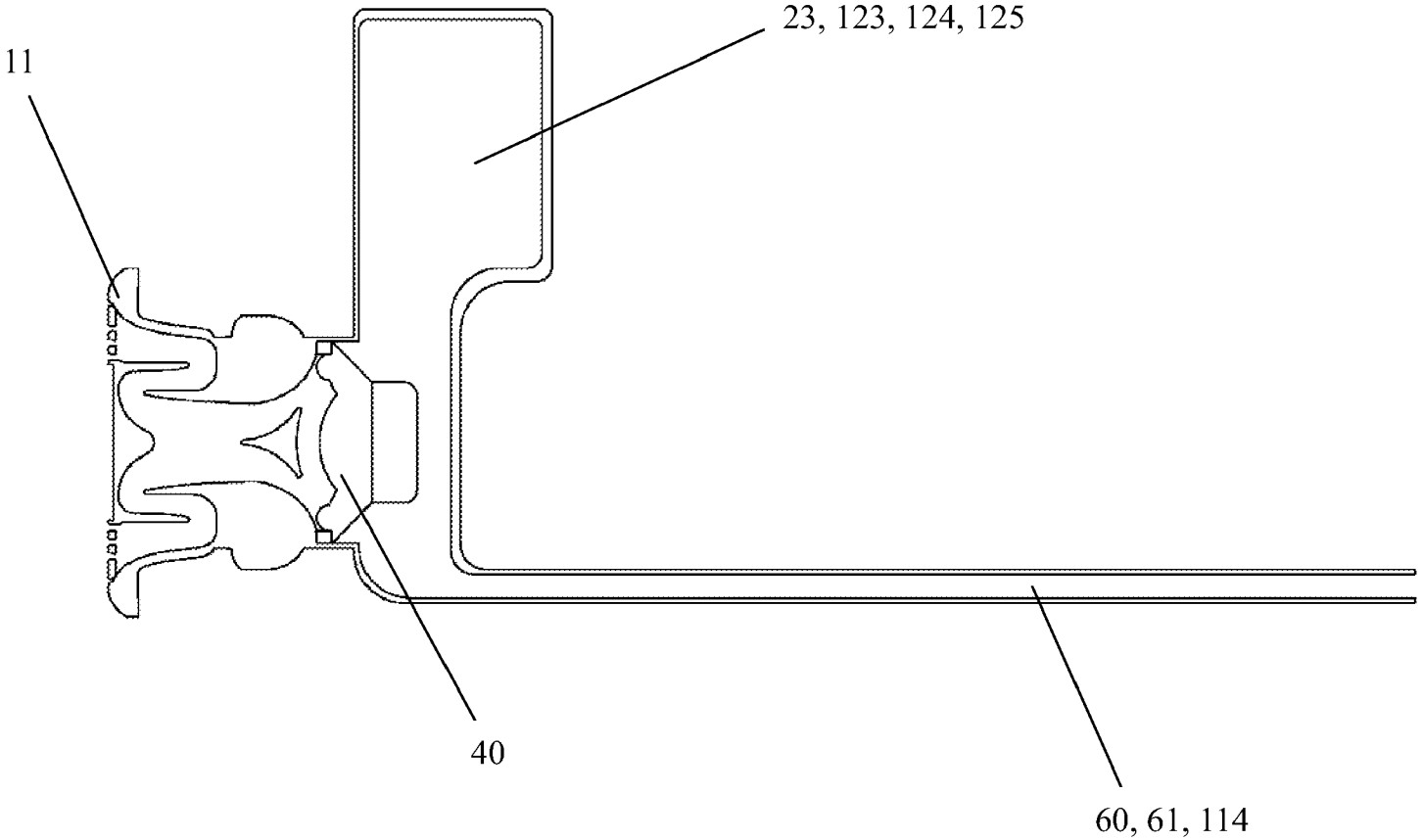
FIG. 9 is a plain view of the present invention, showing a resonance space formed of the equalizer and the bass tube, FIG. 10 corresponds to FIG. 9, showing the chamber formed of the trapezoidal first bass resonator tube and the trapezoidal second bass resonator tube.
Figure 10:
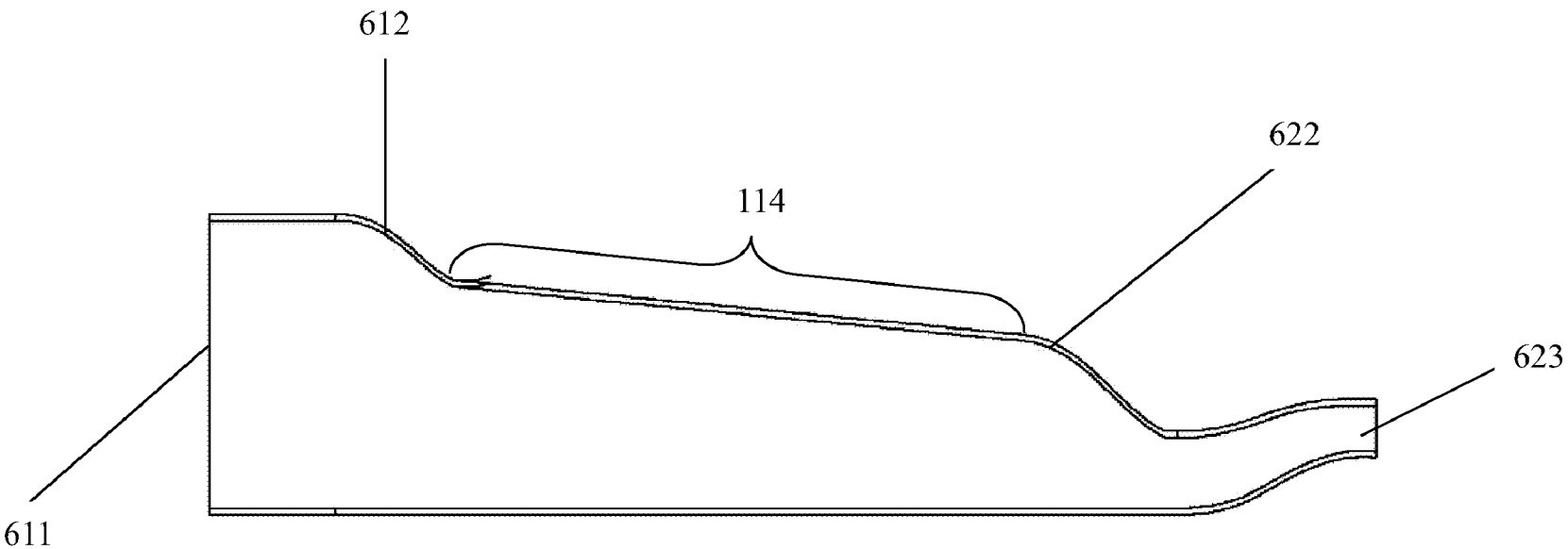

To facilitate understanding of the objects, features and benefits of the present invention, an example of the combination of the front horn and the rear bass is outlined hereinafter. FIG. 9 illustrates the resonance space formed of the front horn, the equalizer and the bass tube. As illustrated, forward waves produced by the speaker unit 40 are emitted by the front horn 11, wherein the high frequency sound waves are buffered by the equalizer 50 and transmitted to the front horn 11 for output to produce pleasant treble. The first resonance chamber 23, the second resonance chamber, the third resonance chamber and the fourth resonance chamber 125 resound the low frequency backward sound waves to match with the performance of the resonance zones 612 and 622 of the trapezoidal first bass resonator tube 61 and trapezoidal second bass resonator tube 62 and the channel tube 114 (see FIGS. 9 and 10) that amplify bass waves, achieving high-performance, full-range speaker functions.

Referring to FIGS. 1~4, a stand 13 is provided at the bottom side of the rear cover shell 12. The stand 13 comprises a pivot shaft 131 and a base frame 132. The holder base 70 is fixedly fastened to the inside of the rear cover shell 12. The pivot shaft 131 has one end joined to the rear cover shell 12 and the holder base 70, and the other end pivotally connected to the base frame 132. By means of biasing the pivot shaft 131, the base frame 132 is moved between a received position where the base frame 132 is closely attached to the bottom side of the rear cover shell 12, and an extended position where the base frame 132 is kept apart from the rear cover shell 12 to support the rear cover shell 12 in vertical. The holder base 70 further has a connection portion 701 disposed at the bottom side. The pivot shaft 131 has a retaining portion 1311 connected to the connection portion 701. The connection portion 701 is shaped like a rectangular frame defining an arched coupling groove. The retaining portion 1311 is a cylindrical member perpendicularly extended from the pivot shaft 131 and coupled to the arched coupling groove of the connection portion 701 so that the stand 13 is connected to and movable relative to the rear cover shell 12 that is affixed to the holder base 70.

A prototype of high-performance, full-range speaker assembly has been constructed with the features of FIGS. 1~10. The high-performance, full-range speaker functions smoothly to provide all of the features disclosed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A high-performance, full-range speaker assembly, comprising:

a front horn, said front horn comprising a channel tube arranged on the inside around the border;

a holder base set between a bass resonator and a rack, said holder base comprising a sound transmission passage in air communication with said front horn and a first resonance chamber defined in a top rectangular opening thereof;

a speaker unit mounted on said holder base and adapted to output sounds toward said sound transmission passage;

an equalizer, said equalizer comprising a cone head inserted into said sound transmission passage and a plurality of supporting members respectively extended from said cone head and fastened to said holder frame;

a bass resonator fastened to said channel tube of said front horn, said bass resonator comprising a cover, a first trapezoidal bass resonator tube and a second trapezoidal bass resonator tube, said first trapezoidal bass resonator tube and said second trapezoidal bass resonator tube respectively perpendicularly connected to said cover at two opposite lateral sides;

a rack, said rack having one side thereof fastened to said speaker unit and said holder base;

a back cover shell fastened to said rack opposite to said speaker unit and said holder base, said back cover shell defining with said holder base a second resonance chamber at the right side, a third resonance chamber at the left side and a fourth resonance chamber in air communication with said first resonance chamber, said second resonance chamber and said third resonance chamber.

2. The high-performance, full-range speaker assembly as claimed in claim 1, wherein said front horn further comprises a first accommodation chamber, a reflection space, a channel tube, a tubular post, a first reflection hole and a grille.

3. The high-performance, full-range speaker assembly as claimed in claim 2, wherein said grille is a T-shaped member having a grille panel, a box tube perpendicularly extended from a back side of said grille panel, a plurality of sound holes cut through said grille panel around said box tube, and a second reflection hole defined in said box tube.

4. The high-performance, full-range speaker assembly as claimed in claim 2, further comprising a volume control mounted in a chamber formed of a first accommodation chamber in a top side of said front horn and a second accommodation chamber in a top side of said rear cover shell.

5. The high-performance, full-range speaker assembly as claimed in claim 1, wherein said sound transmission passage cut through two opposite sides of said holder base, having a big throat facing said speaker unit and a small throat facing said rear cover shell.

6. The high-performance, full-range speaker assembly as claimed in claim 1, wherein said holder base comprises at least one battery chamber accommodating at least one battery cell that provides said speaker unit with the necessary working voltage, and a battery lid covering said at least one battery chamber to hold said at least one battery cell in place.

7. The high-performance, full-range speaker assembly as claimed in claim 1, further comprising at least one control circuit board fixedly mounted in a locating groove inside said rear cover shell and electrically connected with said speaker unit for receiving an external sound source signal to drive said speaker unit to produce sound.

8. The high-performance, full-range speaker assembly as claimed in claim 1, further comprising a stand pivotally connected to a bottom side of said rear cover shell, said stand comprising a base frame and a pivot shaft extended from said base frame and pivotally connected to said rear cover shell.

9. The high-performance, full-range speaker assembly as claimed in claim 8, wherein said rear cover shell has an air vent.

* * * * *